US005409394A

United States Patent [19]

Astier

[11] Patent Number: 5,409,394

[45] Date of Patent: Apr. 25, 1995

[54] METHOD FOR SECURING A REMOVABLE CONNECTOR ON A FIXED CONNECTOR AND A LOCKING ELEMENT THEREFOR

[75] Inventor: Christian Astier, Grenoble, France

[73] Assignee: Hewlett-Packard Company, Palo Alto, Calif.

[21] Appl. No.: 142,725

[22] Filed: Oct. 25, 1993

[30] Foreign Application Priority Data

Nov. 6, 1992 [FR] France ..... 92 13633

[51] Int. Cl.[6] ..... H01R 13/639

[52] U.S. Cl. ..... 439/347; 439/373

[58] Field of Search ..... 439/345, 346, 347, 373, 439/607, 610, 359, 561–563

[56] References Cited

U.S. PATENT DOCUMENTS

| | | | |
|---|---|---|---|
| 1,598,038 | 8/1926 | Benjamin | 439/347 |
| 1,646,482 | 10/1927 | Hopkins | 439/347 |
| 3,425,025 | 1/1969 | Williams | 439/347 |
| 4,172,627 | 10/1979 | Ricros | 439/347 |
| 5,123,858 | 6/1992 | Haag et al. | 439/347 |
| 5,192,222 | 3/1993 | Krause et al. | 439/347 |

FOREIGN PATENT DOCUMENTS

| | | |
|---|---|---|
| 3029904 | 3/1982 | Germany . |
| 8224008 | 11/1982 | Germany . |
| 941628 | 11/1963 | United Kingdom . |

*Primary Examiner*—Daniel W. Howell
*Assistant Examiner*—Hien D. Vu

[57] ABSTRACT

A locking element fixes a removable connector to a complementary fixed connector provided in a wall. The locking element is provided with first locking means engageable by sliding in a predetermined direction perpendicular to the axis of the removable connector and the fixed connector, with complementary locking means of the removable connector. The locking element is provided with second locking means engageable by sliding in the predetermined direction, with complementary locking means of the wall.

6 Claims, 2 Drawing Sheets

METHOD FOR SECURING A REMOVABLE CONNECTOR ON A FIXED CONNECTOR AND A LOCKING ELEMENT THEREFOR

BACKGROUND OF THE INVENTION

1. Field of the Invention

The present invention relates to the joining together of two complementary connectors, and in particular of DB-type electric connectors that are frequently used in computer systems.

2. Discussion of the Related Art

FIG. 1 represents a conventional DB-type male connector 5. This connector includes a body 6 provided with a rectangular connection plane 10. The central area of plane 10 includes a plurality of pins 11 extending perpendicularly to plane 10. A metallic shielding and protection wall 12 surrounds the plurality of pins 11. On both sides of the assembly of pins 11, in the vicinity of the shorter sides of the rectangular plane 10, two fixed cylinders 13 are provided, extending perpendicularly to plane 10. Cylinders 13 include a circumferential groove 13-1 in the vicinity of their distal extremity. Hereinafter, "peg" is to be construed as a cylinder 13 provided with this circumferential groove 13-1.

The pegs 13 are part of a locking system for fixing the male connector to a female connector. Pegs 13, in a conventional locking system, cooperate with a locking element that is mounted so as to slide longitudinally, across the body of the female connector. The locking element is formed by a strip element whose extremities are folded against the face oriented towards the plug. Each folded portion is provided with a fork, one opening towards the middle of the strip element, the second opening away from the strip element. Before plugging the male conector into the female connector, the locking element is displaced to one side to allow the pegs 13 to pass through the forks; then the locking element is slid into a locking position where the forks imprison the grooves of pegs 13. The sliding locking element is retained against the body of the female connector by two screws screwed into the body of this connector. The heads of these screws are located between the main part of the locking element and the folded parts and serve as an abutment for the pegs 13 to determine the matching position between the grooves of pegs 13 and the forks of the sliding locking element.

Generally, the fixed connector protrudes from a plate or the wall of an electronic apparatus casing. In most cases, the plate is provided with an aperture large enough to accommodate the body of the fixed connector with its locking element and this does not allow the fixed connecter to be fixed to the plate. In this case, the fixed connector is secured at its back to a printed circuit, for example by means of soldered pins and/or by screws that retain the sliding locking element and then passss through the connector body.

Since the removable connector is only fixed to the socket, a drawback of this assembly is that all the forces applied to the connector are transmitted to the fixed connector. Such forces, amplified by a lever effect, are also transmitted to the means securing the fixed connector to the printed circuit, which rapidly leads to damage of the secural means and/or the printed circuit.

In some cases, the fixed connector is also secured to the above-mentioned plate by the screws holding the sliding locking element. The plate is then provided with an aperture through which only the active part of the connector protrudes, the plate being interposed between the sliding locking element and the body of the connector. A drawback of this solution is that the removable connector, when in its final position, is not fully plugged home in the fixed connector. Indeed, the screws holding the sliding locking element, which serve as an abutment for the pegs 13, are separated from the fixed connector by the thickness of the plate. This drawback could be solved by shortening the pegs to account for the thickness of the plate. This, however, would raise the obvious problem that standard connectors could no longer be used but, on the contrary, a large range of specific connectors would have to be provided because the plates have various thicknesses.

SUMMARY OF THE INVENTION

An object of the invention is to provide a sliding locking system for fixing a removable connector to a complementary fixed connector, which enables the forces transmitted by the removable connector to the fixed connector to be reduced when the fixed connector protrudes from a plate.

Another object of the invention is to provide such a system which allows a standard removable connector to be plugged home into a standard fixed connector that does not have a locking element, even if the fixed connector is fixed on the plate.

These objects are achieved according to the invention with a removable sliding locking element that allows the removable connector to be fixed to the plate and not to the fixed connector. Thus, the forces applied to the removable connector are no longer transmitted to the fixed connector, and elements for holding the locking device, that could prevent the removable connector from being plugged home, are no longer necessary.

The present invention more particularly concerns a locking element for fixing a removable connector to a complementary connector provided in a wall, such locking element being provided with first locking means engageable by sliding in a predetermined direction perpendicular to the axis of the connectors, with complementary locking means of the removable connector. According to the invention, the locking element is provided with second locking means engageable by sliding in said predetermined direction with complementary locking means of the wall.

According to an embodiment of the invention, the locking element includes a plate provided with an aperture for the passage of an active portion of the removable or fixed connector, the plate being provided with slots forming the first slide locking means and cooperating with pegs of the removable connector.

According to an embodiment of the invention, the locking element includes flat hooks forming the second locking means, all oriented in the same direction parallel to said predetermined direction, and engageable in slots of the wall to lock the locking element against the wall after sliding in said predetermined direction.

According to an embodiment of the invention, the flat hooks are formed by punching and 90° folding of the plate.

The invention also provides a method for fixing a removable connector, provided with first locking members, on a complementary fixed connector provided in a wall, including the steps of: providing second locking members on the wall; placing a locking element between the removable connector and the fixed connector, this locking element being provided with third and fourth locking members, respectively complementary to the first and second locking members; engaging the removable connector with the fixed connector; and sliding the locking element so that its locking members cooperate in locking relation with the locking members of the removable connector and the wall.

The foregoing and other objects, features, aspects and advantages of the invention will become apparent from the following detailed description of the present invention which should be read in conjunction with the accompanying drawings.

DETAILED DESCRIPTION

Figure 1:
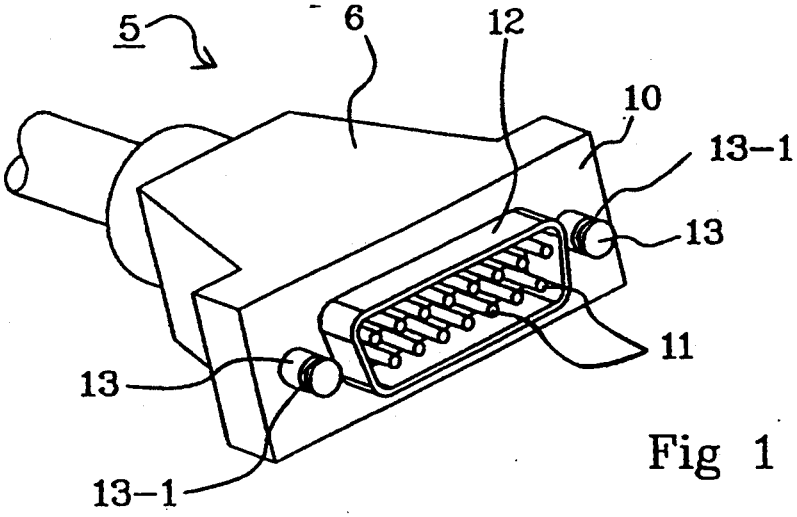
FIG. 1, described above, represents a removable male connector provided with pegs for cooperating with a conventional locking element included in a female connector.

A locking element according to the invention is intended to cooperate with a removable connector, such as that of FIG. 1, provided with locking pegs 13.

Figure 2A:
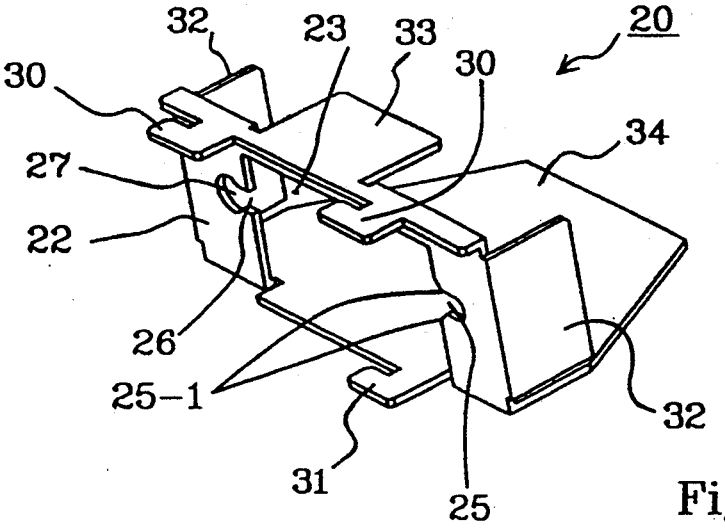
FIGS. 2A and 2B represent an embodiment of a locking element, according to the invention, fabricated by punching and folding a metal sheet.

FIG. 2A is a perspective view of an embodiment of a locking element according to the invention. The locking element can be easily fabricated by folding a punched metal plate or sheet, shown before its folding in FIG. 2B.

The locking element includes a rectangular plane 22 provided with a central rectangular aperture 23 for permitting the connection pins 11 and the protection wall 12 of a male connector to pass towards the associated female connector. Two slots, 25 and 26, open into the shorter sides of aperture 23, approximately in the middle of these sides. The width of slots 25 and 26 is approximately equal to the smallest diameter of pegs 13 (the diameter at their circumferential groove 13-1). Additionally, one of the slots, 26, includes at its blind end a circular portion 27 having a diameter approximately equal to the largest diameter of pegs 13. The areas where slot 25 opens into aperture 23 are bevelled as shown by 25-1.

The long edges of the rectangular plane 22 are provided with hooks extending first perpendicularly to plane 22, then parallel to plane 22 in the direction of slot 26. The hooks are formed by punched sheet portions that are folded at 90° to plane 22. As shown, one of the long edges of plane 22 includes two hooks 30; the second edge has a single hook 31 for reasons that are explained hereinafter, which depend on the specific configuration of the described locking element. Hooks 30, 31 are designed to enter slots (described later) of a wall through which protrudes a fixed connector with which the removable connector is to be engaged.

Figure 2B:
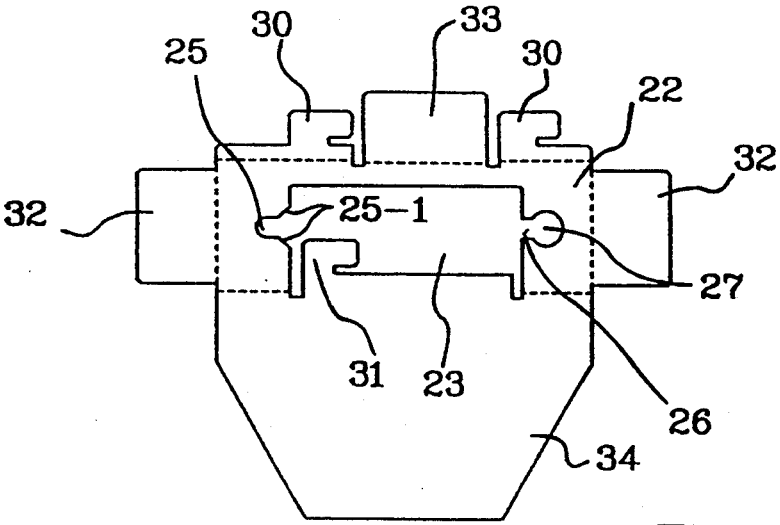

Additionally, locking element 20 includes walls extending from the edges of plane 22 on the other side of this plane with respect to hooks 30, 31. Two walls 32 extend from the shorter edges of plane 22, a wall 33 extends from the upper long edge of plane 22 between hooks 30, and a large wall 34 extends from the lower long edge of plane 22 and occupies the whole length of this edge. These walls 32–34 are formed by sheet portions that are folded at 90° to plane 22. As shown in FIG. 2B, before folding, hook 31 extends from the wall 34 and it attains its 90° position to plane 22 as a result of the folding of wall 34.

It will be noted, in FIG. 2B, that the lower hook 31 is punched in the aperture 23 and is at the same level as one of the upper hooks 30. The second upper hook 30 overlaps a portion of aperture 23 and a solid portion of plane 22; with this configuration, a lower hook 31 cannot be punched in aperture 23, at the same level.

The large wall 34 serves as a support wall for the body of the removable connector and provides a good grip of the removable connector and locking element. Walls 32 and 33 are useful for pre-positioning of the connector body.

Various alternative forms for the punched and folded locking element 20 will be apparent to those skilled in the art. If the support wall 34 is not provided, the locking element 20 can be symmetric with respect to a longitudinal axis and can include four hooks. If wall 34 is provided, the upper hooks 30 can be placed closer to each other so as to permit the provision of two lower corresponding hooks 31 in aperture 23. However, bringing the hooks closer together decreases the efficacy of the locking element. To simplify manufacture, the lower hook 31 need not be provided. In this case, the locking element is preferably used so that hooks 30 are at the top. Indeed, in most cases, the body of the connector lies by gravity on the support wall 34, and it is then the upper hooks 30 that are the most stressed.

If a lower hook 31 is provided, it is preferably symmetrically disposed relative to an upper hook 30 with respect to the center of the locking element 20. With four symmetric slots placed around the fixed connector, this solution enables the lock 20 to be used both in a first position and in a position rotated 180° about the axis of the connectors.

Figure 3A:
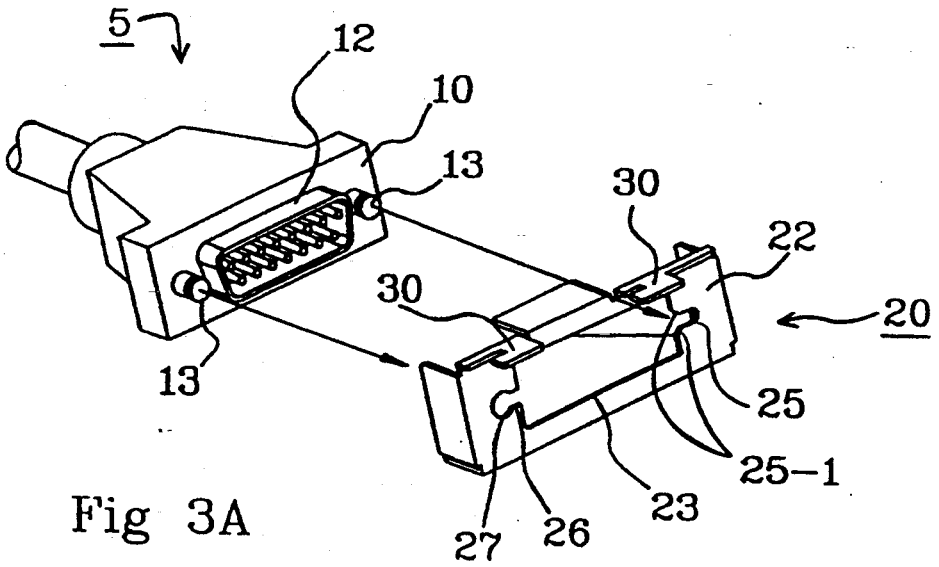
FIGS. 3A, 3B and 3C illustrate three successive steps for fixing a removable connector by means of a locking element according to the invention.
Figure 3B:
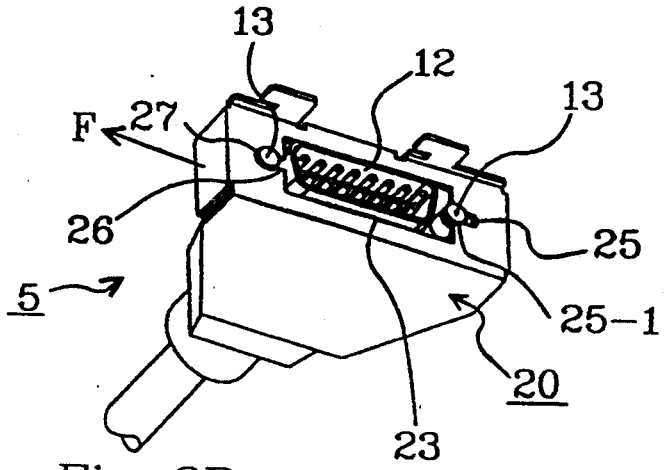
Figure 3C:
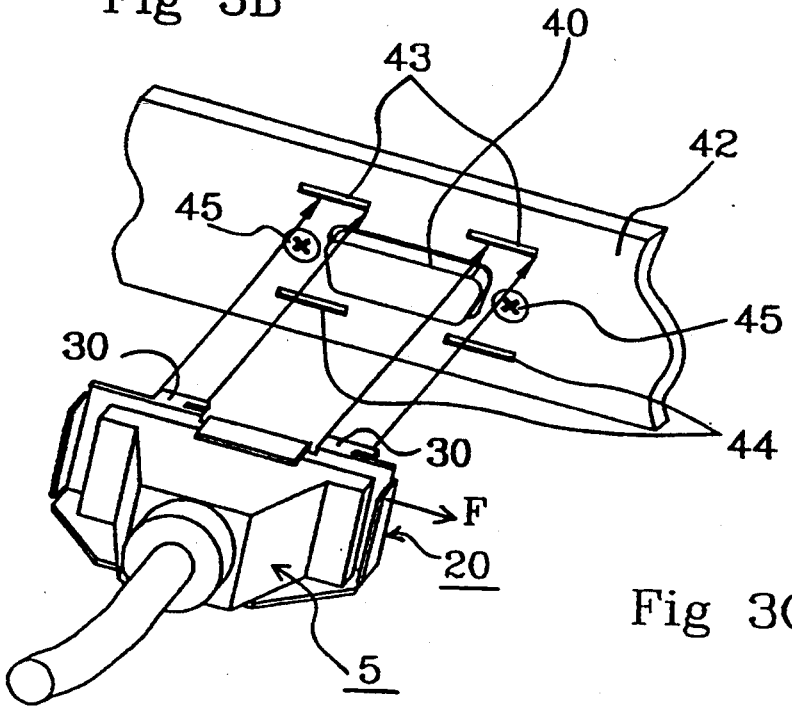

The arrangement of hooks 30, 31, as well as slots 25, 26/27, will be better understood with reference to the description of FIGS. 3A–3C.

FIGS. 3A, 3B, and 3C illustrate three successive steps for fixing a removable connector with its locking element according to the invention. The illustrated removable connector 5 to be fixed is a male connector provided with lock pegs 13. Of course, the connector 5 could also be a female connector, provided with pegs 13, to be engaged with a fixed male connector.

In FIG. 3A, a locking element 20 according to the invention, provided for example with two hooks 30, is held by a user near the connector 5 so that hooks 30 are oriented away from connector 5 and so as to approximately match slots 25 and 26 with pegs 13.

In FIG. 3B, the hole 27 at the blind end of slot 26 is slid over one peg 13. The length of aperture 23 is such that the end of the second peg 13 passes without hinderance where slot 25 opens in aperture 23. Also, as represented in the figures, the areas where slot 25 opens in aperture 23 can be bevelled. Thus, the length of aperture 23 can be selected such that the peg 13 associated with slot 25 is partially engaged into slot 25 (in the bevels), which enables pre-positioning of the locking element 20 before the locking operation.

In FIG. 3C, the assembly of locking element 20 and connector 5, arranged as shown in FIG. 3B, is held so as to face a female connector 40 passing through a casing wall 42. Sufficient clearance between wall 42 and connector 40 is provided to allow the passage there through of the protection wall 12 of connector 5. As represented in FIG. 3C, two slots 43 are provided in wall 42 above socket 40. Slots 43 are parallel to a longitudinal axis of the locking element 20 and correspond to the upper hooks 30 in the given example. Two additional slots 44, disposed symmetrically with respect to the center of connector 40, are also provided in wall 42 so as also to be able to fix connector 5 after turning the locking element 20 upside-down (hooks 30 then being at the bottom of lock 20). Additionally, the four symmetrical slots 43, 44 allow, independently of the number of hooks that are provided (2, 3 or 4), the locking element 20 to be turned upside-down.

On engaging the male connector 5 into the female connector 40, hooks 30 enter slots 43. Once the connector 5 has been pushed home (for example, when the protection wall 12 of the connector 5 abuts against the body of the female connector 40), the locking element 20 is shifted in the direction indicated by arrow F (towards the right in FIG. 3C). As a result, slots 25 and 26 imprison the associated pegs 13, and hooks 30 are locked at one end of their respective slots (right-hand portion in FIG. 3C).

The connector 5 is thus fixed to wall 42 and not to the complementary connector 40. Any force transmitted to the connector 5 is transmitted through the locking element 20 to the wall 42 which is much more rigid than the connector 40.

Additionally, countersunk screws 45 fix the connector 40 to the wall 42 by means of threads conventionally provided in the connector 40.

As is apparent to those skilled in the art, various modifications can be made to the above disclosed preferred embodiments. For example, the locking element can be cast, which would enable the four fixing hooks to be more easily provided.

Although a hook system has been described for hooking the locking element 20 on a wall, any alternative locking means can be provided, as, for example, pegs integral with locking element 20, and cooperating with slots in the wall, or the other way around.

I claim:

1. A connector arrangement comprising:

a removable connector provided with first locking members;

a structure provided with a wall having second locking members;

a fixed connector provided in said wall, the fixed connector being fixed to said structure and said removable connector being engageable with said fixed connector by movement theretowards along a predetermined axis of engagement; and a locking element for locking the removable connector into engagement with the fixed connector, said locking element being separable from both connectors when the connectors are disengaged from each other, said locking element including third and fourth locking members which are, respectively, complementary to said first and second locking members and are movable into a locking relation therewith, said locking element positioned between said connectors as they are moved into engagement and then moved in a predetermined direction perpendicular to said axis of engagement to cause a locking action between said first and third locking members and said second and fourth locking members.

2. A connector arrangement according to claim 1, wherein:

said first locking members are pegs having circumferential grooves;

said locking element comprises a plate having portions defining both an aperture through which said connectors can engage, and a plurality of slots; and said third locking members are portions of the plate defining said slots and are engageable in said circumferential grooves of said pegs forming said first locking members.

3. A connector arrangement according to claim 2, wherein said wall is formed with slots thereby to provide said second locking members, said locking element having flat hooks forming said fourth locking members, said hooks all having a common orientation and being engageable in said slots formed in said wall to lock the locking element against the wall after movement in said predetermined direction.

4. A connector arrangement according to claim 3, wherein said flat hooks are formed by punching and 90° folding of said plate.

5. A connector arrangement according to claim 1, wherein said connectors are DB-type electrical connectors, the removable connector being a male connector and the fixed connector a female connector.

6. A method for fixing a removable connector, provided with first locking members, on a complementary fixed connector provided in a wall, including the following steps:

providing second locking members on said wall;

placing a locking element between the removable connector and the fixed connector, said locking element being provided with third and fourth locking members, respectively complementary to said first and second locking members;

engaging the removable connector with the fixed connector; and sliding the locking element so that its locking members cooperate in locking relation with the locking members of the removable connector and the wall.

* * * * *